US009395127B2

(12) United States Patent
Bodas et al.

(10) Patent No.: US 9,395,127 B2
(45) Date of Patent: Jul. 19, 2016

(54) INDIRECT DRY COOLING TOWER APPARATUS AND METHOD

(75) Inventors: Janos Bodas, Huba Vezer (HU); Balazs Sagi, Perkata (HU); Attila Solyom, Budapest (HU)

(73) Assignee: SPX Dry Cooling USA LLC, Overland Park, KS (US)

( * ) Notice: Subject to any disclaimer, the term of this patent is extended or adjusted under 35 U.S.C. 154(b) by 1067 days.

(21) Appl. No.: 12/627,394

(22) Filed: Nov. 30, 2009

(65) Prior Publication Data

US 2010/0276129 A1 Nov. 4, 2010

Related U.S. Application Data

(60) Provisional application No. 61/175,319, filed on May 4, 2009.

(51) Int. Cl.

| | |
|---|---|
| ***F24H 3/00*** | (2006.01) |
| ***F28F 27/02*** | (2006.01) |
| ***F28F 9/26*** | (2006.01) |
| ***F01K 9/00*** | (2006.01) |
| ***F28B 1/06*** | (2006.01) |
| ***F28B 9/06*** | (2006.01) |
| ***F28D 1/00*** | (2006.01) |

(52) U.S. Cl.

CPC . *F28F 27/02* (2013.01); *F01K 9/00* (2013.01); *F28B 1/06* (2013.01); *F28B 9/06* (2013.01); *F28D 1/00* (2013.01)

(58) Field of Classification Search

CPC ..... F28F 27/003; F28F 27/02; F28F 9/26; F28B 1/06; F28C 1/14; F28C 2001/006

USPC ..... 261/146, 150, 152, DIG. 11, DIG. 87; 165/144, 147, 100, 900, 226, 95, 143, 165/47

See application file for complete search history.

(56) References Cited

U.S. PATENT DOCUMENTS

| | | | | | |
|---|---|---|---|---|---|
| 343,529 | A | * | 6/1886 | Daltry | 137/161 |
| 1,899,629 | A | * | 2/1933 | Morse | 165/134.1 |
| 2,519,266 | A | * | 8/1950 | Main | 237/8 R |
| 3,171,258 | A | * | 3/1965 | Caldwell et al. | 60/688 |
| 3,259,177 | A | * | 7/1966 | Niemann | F28B 1/06 165/101 |
| 3,434,529 | A | | 3/1969 | Daltry | |

(Continued)

OTHER PUBLICATIONS

European Search Report issued by the EPO on Oct. 29, 2012 for Application No. 10772688.7.

*Primary Examiner* — Allen Flanigan
*Assistant Examiner* — Jason Thompson
(74) *Attorney, Agent, or Firm* — Baker Hostetler LLP

(57) ABSTRACT

A heat exchange apparatus that extends vertically along a longitudinal axis, that cools a liquid, including: a first delta positioned at a first point along the longitudinal axis, the first delta including: a first inlet conduit for inlet liquid flow, the first inlet conduit being in fluid communication with a first inlet main, and a first outlet conduit for outlet fluid flow, the first outlet conduit being in fluid communication with the first inlet conduit and a first outlet main, and a second delta positioned at a second point along the longitudinal axis above the first delta, the second delta including: a second inlet conduit for inlet liquid flow, the second inlet conduit being in fluid communication with a second inlet main, and a second outlet conduit for outlet fluid flow, the second outlet conduit being in fluid communication with the second inlet conduit and a second outlet main.

6 Claims, 14 Drawing Sheets

(56) References Cited

U.S. PATENT DOCUMENTS

| | | | | | |
|---|---|---|---|---|---|
| 3,881,548 | A | | 5/1975 | Budenholzer | |
| 3,915,223 | A | * | 10/1975 | Kelp | 165/111 |
| 3,916,638 | A | | 11/1975 | Schmidt | |
| 4,020,899 | A | * | 5/1977 | Langerock | 165/110 |
| 4,036,021 | A | * | 7/1977 | Kelp | 60/692 |
| 4,098,854 | A | * | 7/1978 | Knirsch et al. | 261/161 |
| 4,114,683 | A | * | 9/1978 | Verlinden | 165/78 |
| 4,243,095 | A | * | 1/1981 | Kosten | 165/125 |
| 4,688,390 | A | | 8/1987 | Sawyer | |
| 4,747,980 | A | * | 5/1988 | Bakay et al. | 261/129 |
| 5,737,937 | A | * | 4/1998 | Akazawa | 62/303 |
| 6,527,046 | B1 | * | 3/2003 | White | 165/297 |
| 2002/0023738 | A1 | * | 2/2002 | Ehlers et al. | 165/125 |
| 2006/0075765 | A1 | | 4/2006 | Huang et al. | |

* cited by examiner

INDIRECT DRY COOLING TOWER APPARATUS AND METHOD

CLAIM FOR PRIORITY

The present application is a nonprovisional application that claims priority to U.S. Provisional Patent Application Ser. No. 61/175,319, filed May 2, 2009, the disclosure of which is hereby incorporated by reference in its entirety.

FIELD OF THE INVENTION

The present invention relates to a natural draft cooling tower with heat exchangers of the dry-type, operating by natural draft and achieving the exchange of heat between two fluids such as atmospheric air, ordinarily, and another fluid, generally water.

BACKGROUND OF THE INVENTION

Indirect dry cooling plants are typically tower arrangements or formations having multiple towers, utilized to dissipate heat from industrial plants using large machinery, such as steam turbines, or industrial processes. For example, one type of cooling tower used in these plants is a chimney-type natural draft cooling tower which has a thin veil of concrete forming the side wall thereof. The chimney is open at the top and is supported above the ground by a plurality of legs, and the space between the lower edge of the veil and the ground defines the cooling air inlet for the heat exchange tower.

In one design of a cooling tower, hot water from a condenser, is directed to the heat exchange units within the tower via a conduit, and the cooled water is directed back to the condenser via the conduit and a pump. As the name suggests, the condenser condenses and cools the exhaust exiting from a turbine and the cooled liquid is pumped to a boiler.

In one example, traditional dry-type heat exchange batteries have finned tubes mounted vertically in pairs and are erected on the ground and concentric to an opening. The batteries are typically V-shaped, so that the heat exchange surface creates a toothed polygon, the teeth of which are directed toward the inside of the tower.

A unit of traditional batteries of dry-type heat exchangers with finned tubes is placed horizontally or in slightly inclined fashion toward the bottom center of the tower, between the upper end of support columns and the upper end of the vertical batteries. The support columns are typically located in a single circular row near the opening inside the tower. Heat exchangers are mounted in pairs in V-shaped configurations, the peaks of which are directed upwards; each of the two units are connected by means of brackets. Because of the radial arrangement of the batteries situated above the air entry, an open space in the shape of a sector whose arc takes the shape of the periphery of the chimney exists between each pair of batteries. The spaces are typically sealed by plates to force the air to cross the batteries. The annular space between the wall and the extremity of the horizontal batteries is sealed off in analogous manner by plates. The same is done with triangular plates for the open space between the upper end of the vertical bottom and the inner end of the horizontal batteries.

Each exchanger unit usually includes two beds. Each unit can be fed with water to be cooled separately or otherwise by means of the heater boxes in which the ends of the tubes of the heat exchange units are connected. Some beds are directly exposed to the cooling air while other beds receive air already partially heated in passing through the first beds.

If the liquid to be cooled is to be circulated in series in each vertical battery and the horizontal battery to which it is affixed, and the cold air is first to meet the ascending current of hot water, the mounting described herein is carried out.

The hot water is typically brought to the tower via a conduit, and deposited in a circular part forming a hot water collector. The collector is provided with a circulation pump, the collector is arranged at right angles to the vertical batteries. Next to the collector, a second circular collector is usually installed and is connected to the conduit to evacuate the cooled water. The orifice of the lower water box of a bed of batteries is connected to the hot water collector; by means of a pipe, the orifice of the upper water box of a bed of batteries is connected to orifice of the water box which is most inside the tower of the bed of batteries. By means of a pipe, the orifice of the water box most inside the tower of a bed of batteries is connected to the orifice of the upper water box of the bed of batteries. By suppressing the internal partition of water boxes of batteries which are most outside the tower, the beds of each horizontal battery are placed into communication with each other. Orifice of lower water box of a bed is connected to the cold water collector.

Since water boxes of the batteries are common to both beds the water circulates automatically from the hot water entry towards the cold water evacuation piping using the beds successively, as soon as the siphon has been primed by a low output pump of greater manometric height than the circulation pump.

The equipment may also have piping that is small in diameter, connected to the highest point of each battery. The pipes evacuate the gas contained in the batteries at the time of the filling of the batteries and the introduction of the gas at the time of the emptying of the batteries. This gas is either atmospheric air, possibly dried, or an inert gas such as nitrogen and its pressure will generally be greater than atmospheric.

The aforementioned dry towers typically have wind screens, analogous to those provided in so-called wet towers, to control the strong winds prevailing in storms, and to minimize the disturbances in the distribution of the air inside the tower. The wind screens consist of flat, vertical walls which extend from the periphery of the tower to the extremities of the batteries, arranged in this case in a cross to divide the cooling system into quarters.

The horizontal batteries are supported directly by the vertical batteries themselves and by a single circular row of poles braced by beams. The latter may, moreover, be replaced by the chimney lintel itself, or by any type of framework. Two gangplanks typically allow for the passage of those persons responsible for surveillance and maintenance of the system.

With the increase of the output of steam turbines, the heat dissipating capacity of conventional indirect dry cooling plants has been required to increase accordingly. This demand has led to the use of extremely tall cooling deltas, up to 30 meters in cases, when a vertical cooling delta arrangement is applied. The cooling delta typically includes of a pair of heat exchanger bundles arranged in delta (i.e., Δ) form, with an apex angle of approximately 60 degrees. In the aforementioned delta arrangement, the two inclined sides are the two bundles, and the horizontal side is an airflow control louver assembly. The delta assembly is supplied with a self supporting prismatic steelwork.

Other solutions have been proposed to increase heat dissipating capacity, for example, a single-pass heat exchanger. However, it does not provide very good heat transfer capabilities. Another example is the use of a larger tube diameter, however, it has too high a pressure drop of the liquid being cooled as the air side pressure drop increases. For good heat transfer, a cross-counter flow pattern is preferred in the deltas, which can be implemented with two passes on the waterside. However, the water has to flow through a 60 meter length of tubes, which involves a high water side pressure loss.

Accordingly, there is a need and desire to provide an indirect dry cooling tower that has good heat transfer and a low pressure drop.

SUMMARY OF THE INVENTION

Embodiments of the present invention advantageously provide an indirect dry cooling tower that has good heat transfer and a low pressure drop.

An embodiment of the invention includes a heat exchange apparatus that extends vertically along a longitudinal axis, that cools a liquid, the apparatus including: a first delta positioned at a first point along the longitudinal axis, the first delta including: a first inlet conduit for inlet liquid flow, the first inlet conduit being in fluid communication with a first inlet main, and a first outlet conduit for outlet fluid flow, the first outlet conduit being in fluid communication with the first inlet conduit and a first outlet main, and a second delta positioned at a second point along the longitudinal axis above the first delta, the second delta including: a second inlet conduit for inlet liquid flow, the second inlet conduit being in fluid communication with a second inlet main, and a second outlet conduit for outlet fluid flow, the second outlet conduit being in fluid communication with the second inlet conduit and a second outlet main.

Another embodiment includes a method for cooling a fluid, the method including: passing a first portion of a fluid to be cooled through a first delta, and passing a second portion of the fluid to be cooled through a second delta above the first delta, and passing air over the first and second deltas.

Another embodiment includes an apparatus for cooling a liquid, the apparatus including: a means for passing a first portion of a fluid to be cooled through a means for a first delta, and a means for passing a second portion of the fluid to be cooled through a means for a second delta above the means for first delta, and a means for passing air over the means for first and second deltas.

Another embodiment includes a heat exchange apparatus that extends vertically along a longitudinal axis, that cools a liquid, the apparatus including: a first delta positioned at a first point along the longitudinal axis, the first delta including: a first inlet conduit for inlet liquid flow, the first inlet conduit being in fluid communication with an inlet main, and a first outlet conduit for outlet fluid flow, the first outlet conduit being in fluid communication with the first inlet conduit and an outlet main, a second delta positioned at a second point along the longitudinal axis above the first delta, the second delta including: a second inlet conduit for inlet liquid flow, the second inlet conduit being in fluid communication with the inlet main, and a second outlet conduit for outlet fluid flow, the second outlet conduit being in fluid communication with the second inlet conduit and the outlet main.

Another embodiment includes an indirect dry cooling tower for providing heat exchange to a fluid, the tower including: a delta tower, including: a first delta positioned at a first point along the longitudinal axis, the first delta including: a first inlet conduit for inlet liquid flow, the first inlet conduit being in fluid communication with a first inlet main, and a first outlet conduit for outlet fluid flow, the first outlet conduit being in fluid communication with the first inlet conduit and a first outlet main, and a second delta positioned at a second point along the longitudinal axis above the first delta, the second delta including: a second inlet conduit for inlet liquid flow, the second inlet conduit being in fluid communication with a second inlet main, and a second outlet conduit for outlet fluid flow, the second outlet conduit being in fluid communication with the second inlet conduit and a second outlet main.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The above-mentioned and other features and advantages of this disclosure, and the manner of attaining them, will become more apparent and the disclosure itself will be better understood by reference to the following description of various embodiments of the disclosure taken in conjunction with the accompanying figures, wherein.

DETAILED DESCRIPTION OF THE INVENTION

In the following detailed description, reference is made to the accompanying drawings, which form a part hereof and show by way of illustration specific embodiments in which the invention may be practiced. These embodiments are described in sufficient detail to enable those skilled in the art to practice them, and it is to be understood that other embodiments may be utilized, and that structural, logical, processing, and electrical changes may be made. It should be appreciated that any list of materials or arrangements of elements is for example purposes only and is by no means intended to be exhaustive. The progression of processing steps described is an example; however, the sequence of steps is not limited to that set forth herein and may be changed as is known in the art, with the exception of steps necessarily occurring in a certain order.

Figure 1:
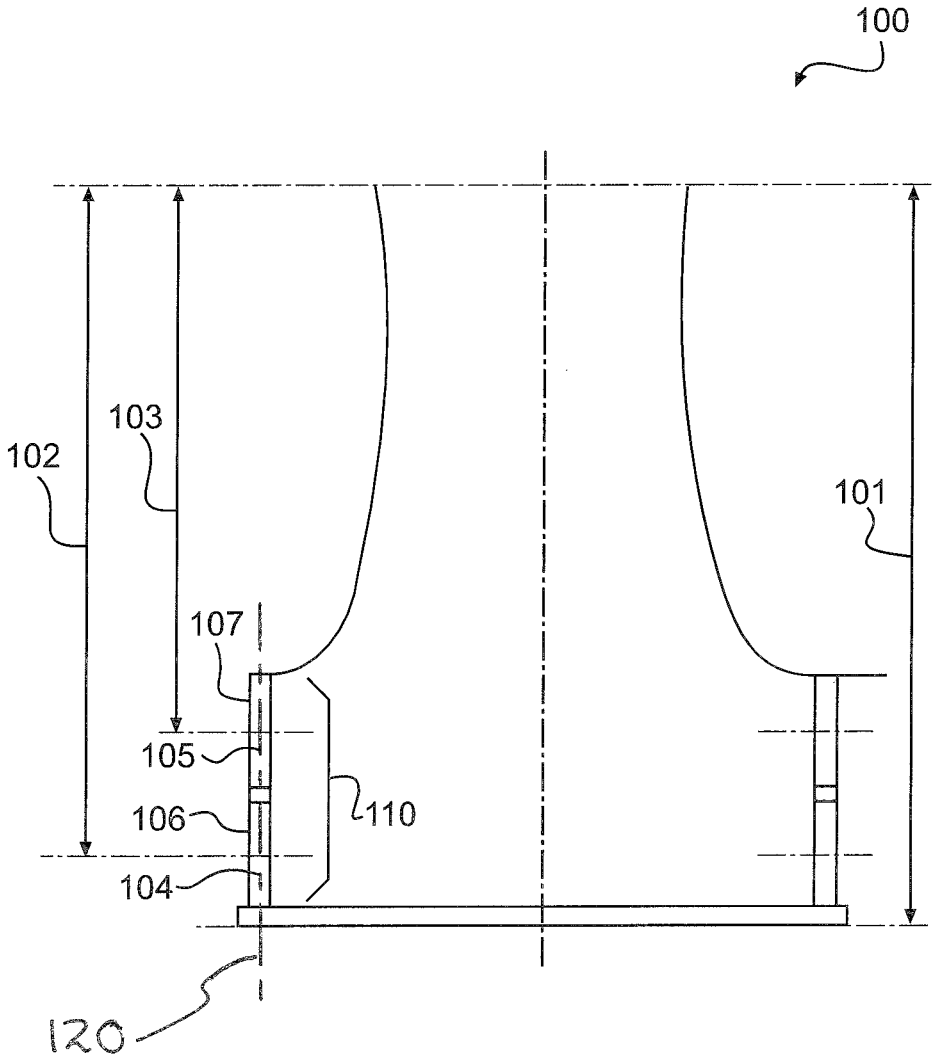
FIG. 1 is a side schematic view of an indirect dry cooling tower in accordance with an embodiment of the invention.
Figure 8:
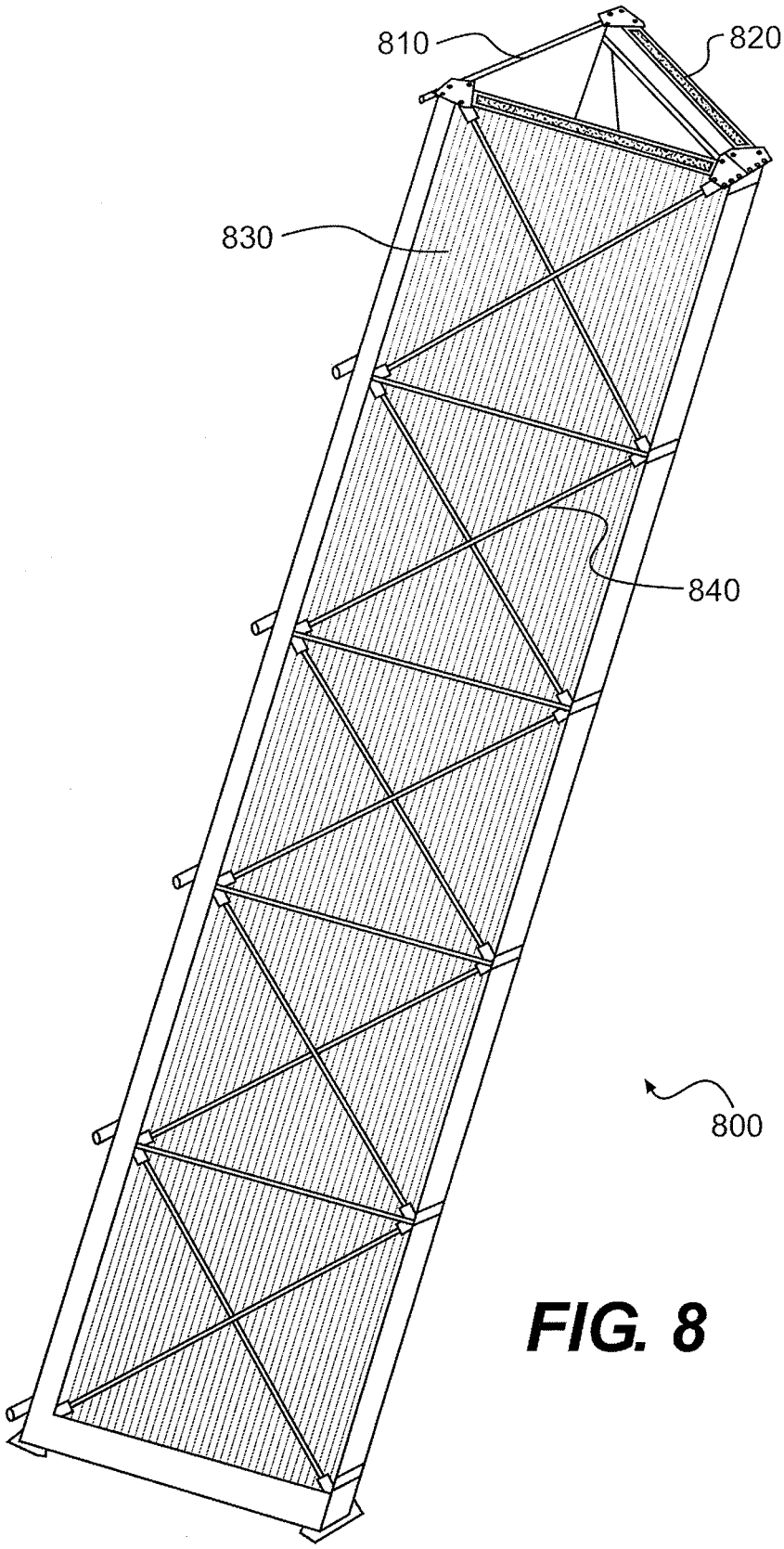
FIG. 8 is a perspective view of a delta in accordance with an embodiment of the invention.

The invention will now be described with reference to the drawing figures in which like reference numerals refer to like parts throughout. Referring now to FIG. 1, an indirect dry cooling tower 100, having a total height 101 and a cooling delta tower 110, is depicted. The cooling delta tower 110 includes of a pair of heat exchanger bundles 820, 830 (see FIG. 8) arranged in delta (i.e., Δ) form, with an apex angle of approximately 40-60 degrees. The two inclined sides are the two bundles, and the third side is an airflow control louver assembly 810 (FIG. 8). The delta assembly may include a frame network 840 (FIG. 8), for example, a self supporting prismatic steelwork.

Referring to FIG. 1, the delta tower 110 includes two similar shortened deltas 104, 105 on a water side, which are installed vertically on a vertical axis 120, on top of one another, forming a bottom level 106 and a top level 107. The deltas 104, 105 may be positioned around the periphery of the tower 100 in a vertical orientation. The bottom and top levels 106, 107 of the delta tower 110 are connected in parallel on the water side. By this previously described arrangement, the water flow in the shortened deltas 104, 105, e.g., the bottom and top levels 106, 107, will be half the height of conventional deltas, and the length of tubes (keeping the two pass, cross-counter flow pattern) is also half that of conventional high deltas. The splitting of the deltas into two, and the arranging the delta towers 110 as two shortened deltas 104, 105 on two levels 106, 107, can drastically reduce the waterside pressure loss and the power demand of cooling water (CW) pumps. Splitting the deltas into two shortened deltas reduces the required water flow per delta to one half that of the long deltas, and hence reduces the water velocity, as well. Moreover, the aforementioned halved height reduces the velocity of the required water flow. As understood by one skilled in the art, the pressure loss is approximately proportional to the square of the velocity, so the reduced velocity reduces the pressure loss.

With the above-described two-level arrangement, the effective tower height (the height which creates the draft in the tower) of the bottom level 102 differs from the effective tower height of the top level 103. For example, the higher effective tower height of the bottom level 102 functions to induce more draft and more airflow through the bottom level deltas. In the case of identical water flow in both levels, for example, the exit water temperature of the bottom level deltas 104 is typically cooler than that of the top level. Since the exit water from the bottom and top-level coolers may differ, thermodynamic issues can arise, as mixing water flows having different temperatures increases entropy, which indicates inefficiency of the process. Therefore, it is preferred that the exit water temperature of both levels be equal to achieve maximum process efficiency. Accordingly, in order to achieve similar or equal exiting water temperature, the cooling water flow through the top-level deltas 105 is controlled (throttled) relative to the CW flow in the bottom level deltas 104. Thus, embodiments of the invention include a throttling device for controlling the top-level water flow. The throttling device can be a butterfly or gate valve, a throttling orifice, or other appropriate throttling or control device. Such a throttling device is described in further detail below.

Figure 2:
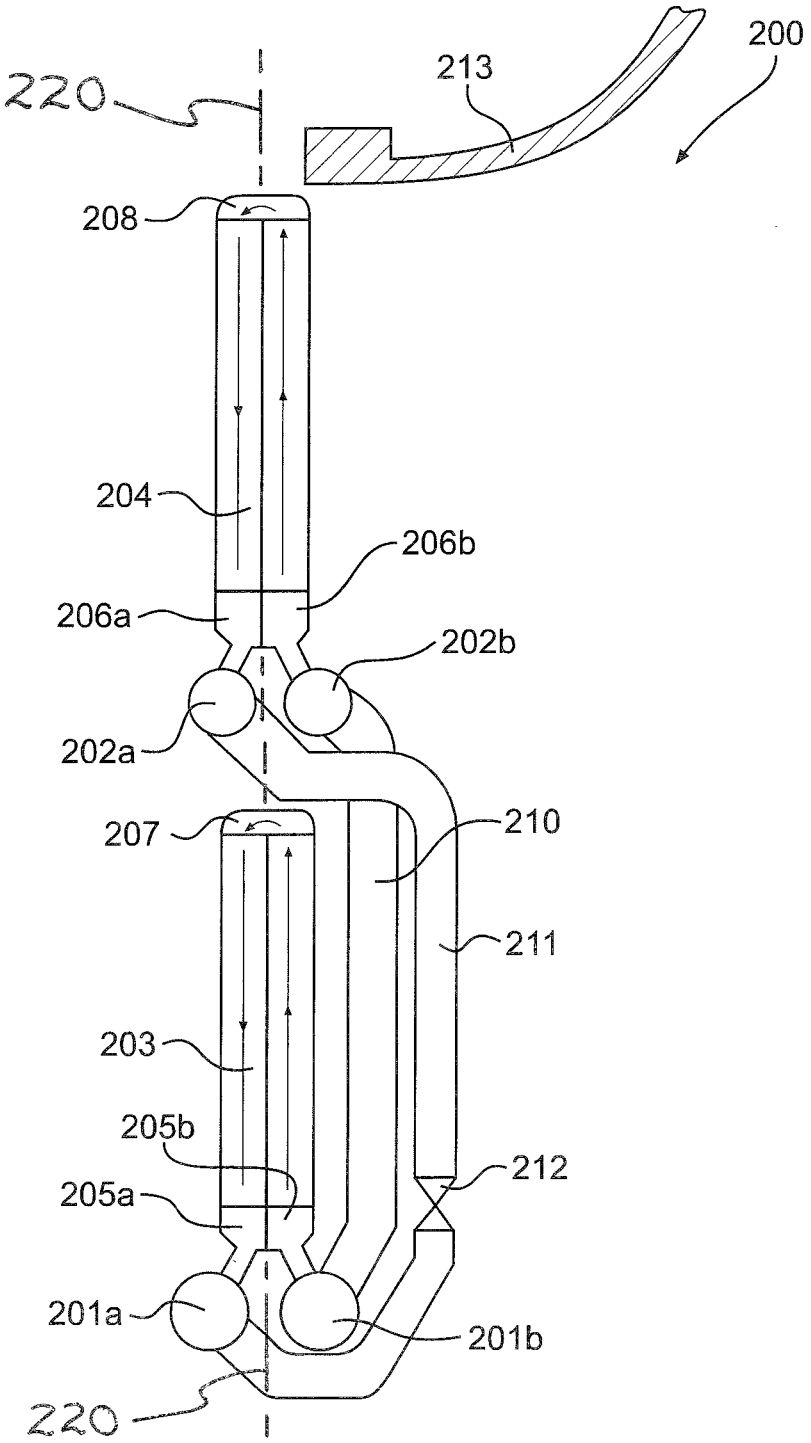
FIG. 2 is a schematic view of a conduit orientation and structure for a delta utilized within a cooling tower in accordance with an embodiment of the invention.

FIG. 2 illustrates an embodiment of the invention wherein a tower 200 includes bottom level outlet and inlet mains 201*a*, 201*b*, top level outlet and inlet mains 202*a*, 202*b*. The tower 200 further includes a bottom level cooling delta 203, a top level cooling delta 204 above the bottom level cooling delta 203 on a vertical axis 220, bottom level lower headers 205*a*, 205*b*, top level lower headers 206*a*, 206*b*, a bottom level upper header 207, and a top level upper header 208. One bottom level lower header 205*b* and one upper level lower header 206*b* are inlet conduits. The other bottom level lower header 205*a* and other upper level lower header 206*a* are outlet conduits. The tower 200 also has a first connecting conduit 210 that extends between the inlet mains 201*b*, 202*b* on the bottom and top levels, e.g., levels 106, 107, a second connecting conduit 211 that extends between the outlet mains 201*a*, 202*a* of the bottom and top levels, e.g., levels 106, 107, and a throttle valve 212 to control the cooling water flow from the top level delta 204. As depicted in FIG. 2, the arrows indicate the direction of the flow of liquid, e.g., water, in the deltas. As also illustrated in FIG. 2, the tower shell 213 extends above the height of the upper header 208. The connecting conduits 210, 211 may each be a large-diameter tube, capable of supplying the cooling water for a number of towers 200. The connecting conduits 210, 211 may also be bundles of small-diameter tubes, which may require less pressure than a single large-diameter tube.

The control or throttling of the cooling water flow from the top level delta 204 can be implemented such that both the bottom and top levels 106, 107 of the tower 100 are equipped with outlet and inlet mains 201*a*, 201*b*, 202*a*, 202*b*. Accordingly, the bundles of the deltas, e.g., shortened deltas 104, 105, are connected to these mains 201*a*, 201*b*, 202*a*, 202*b*, and the throttling device 212 is built into the connecting conduit 211 between the outlet mains 201*a*, 202*a*. The throttling device 212 can be a butterfly or gate valve, a throttling orifice, or other appropriate throttling or control device.

Referring to FIG. 2, during operation, heated liquid, e.g., water, flows from the bottom level inlet main 201*b* into the first connecting conduit 210, and from the first connecting conduit 210 into the top level inlet main 202*b*. A portion of the heated water is diverted into the top delta 204, while the remaining water is diverted to the bottom delta 203. In each delta 203, 204, the heated water flows upward, as indicated by the arrows, then downward, where it comes in contact with air that indirectly cools the water before exiting the deltas 203, 204. In order to maintain the same temperature exiting both deltas, 203, 204, water in the second connecting conduit 211 may be throttled to slow the flow by the throttling device 212 such as a valve or the like.

Large natural draft cooling towers similar to the above-discussed towers 100, 200 may be divided into four to twelve similar sectors that allow for easy and safe filling and draining operations. The individual natural draft cooling sectors can be filled, drained, and operated independently from each other.

A thermometer (not shown) or similar temperature gauge may provide a temperature reading that may assist in controlling the throttling device 212 in such a way that the exit temperature of liquid from the top level 105 should preferably be approximately equal with that of the exit temperature of liquid from the bottom level 104. The thermometer or temperature gauge may be installed into the bottom level outlet main 201*a* and another one into the top level outlet main 202*a* and connecting these thermometers to an electronic or other type control device.

Figure 3:
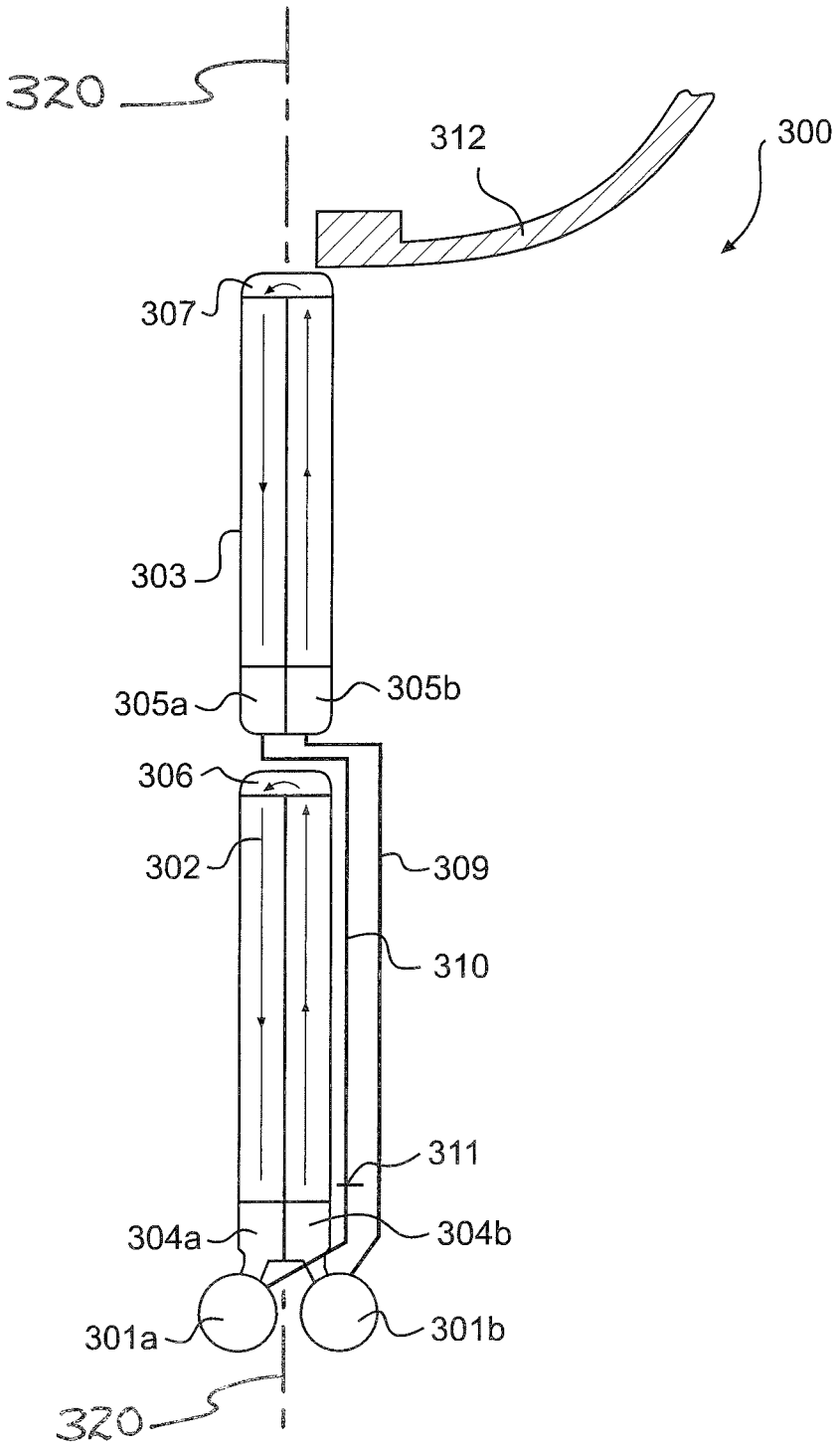
FIG. 3 is a schematic view of a conduit orientation and structure for a delta utilized within a cooling tower in accordance with another embodiment of the invention.

FIG. 3 shows another embodiment in which a tower 300 includes bottom level outlet and inlet mains 301*a*, 301*b*, a bottom level cooling delta 302, a top level cooling delta 303 above the bottom level cooling delta 302 on a vertical axis 320, bottom level lower headers 304*a*, 304*b*, top level lower headers 305*a*, 305*b*, a bottom level upper header 306, and a top level upper header 307. The tower 300 further includes a connecting conduit 309 that extends between the inlet main 301*b* on the bottom level and the top level lower header 305*b*. The tower 300 may also have a connecting conduit 310 that extends between the outlet main 301*a* on the bottom level and the cooling deltas lower header 305*a* on the top level. There may also be an optional throttling orifice 311. As depicted in FIG. 3, the arrows indicate the direction of the flow of liquid, e.g., water, in the deltas. The tower shell 312 extends above the height of the upper header 307. The connecting conduits 309, 310 may each be a conduit having a large diameter or bundles of small tubes, which may require less pressure than a single large tube. In a preferred embodiment, the connecting conduits 309, 310 may each be a conduit having a pair of small-diameter pipes belonging to each set of bottom and top level cooling deltas 302, 303, feeding each top level cooling delta 303 separately. The operation of this configuration may be similar to that of tower 200 discussed in connection with FIG. 2.

As illustrated in FIG. 3, the control or throttling can be implemented such that the outlet and inlet mains 301*a*, 301*b* are on the bottom level only, e.g., for delta 302. In such an arrangement, the top level delta 303 has cooling water supply (inlet) and return (outlet) pipes 309, 310, e.g., connecting conduits. The diameter of these pipes 309, 310 could be selected, e.g., by calculation, to provide the necessary throttling effect. The pipes 309, 310 may optionally be composed of multiple small-diameter pipes. The bottom level delta 302 may also be fed from the mains 301*a*, 301*b* with additional connecting pipes similar to pipes 309, 310, which may also be smaller diameter pipes. Another option may be to install throttling orifices 311 into any or all of the return pipes 310 of the top-level delta 303.

Figure 4:
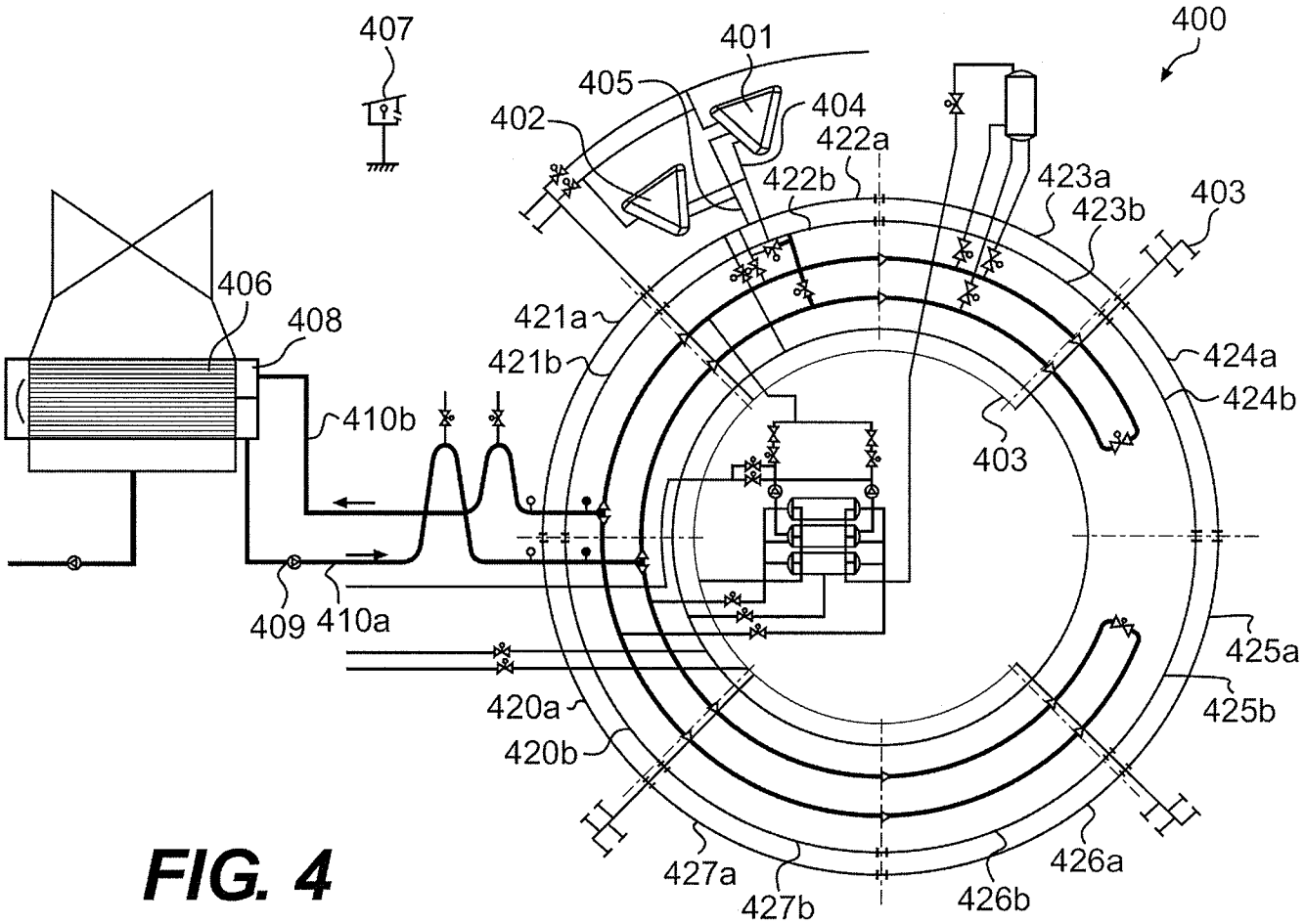
FIG. 4 is a schematic view of a conduit orientation and structure within a cooling tower in accordance with an embodiment of the invention.

FIG. 4 depicts a tower 400 wherein top and bottom deltas 401, 402 are connected to the sector distributing and cooling conduits 421*a* and 421*b*. Liquid, e.g., to be cooled is pumped to the deltas 401, 402 via an input line 404. The cooled water flows or returns to a surface condenser 406 via output line 405. Arrows indicate the direction of water flow. A temperature gauge, such as a thermometer 407, may monitor the ambient temperature to allow for adjustments based on expected cooling speeds. Heated water may be sent from a divided header 408 in the condenser 406 by a cooling water pump 409 to each delta 401, 402. Cooled water returns via a return line 410*b* to a header 408 in the condenser 406. Each delta sector 420-427 may have a respective pair of top and bottom deltas 401, 402, each connected to the respective sector distributing and collecting pipes 421*a* and 421*b*. A tower 400 may have multiple such sectors. The tower 400 may have a single connected pipe system (410*a* and 410*b*) connecting the heated water input from the cooling water pump 409, through the pipe 410*a*, and back to the return line 410*b*.

Figure 5B:
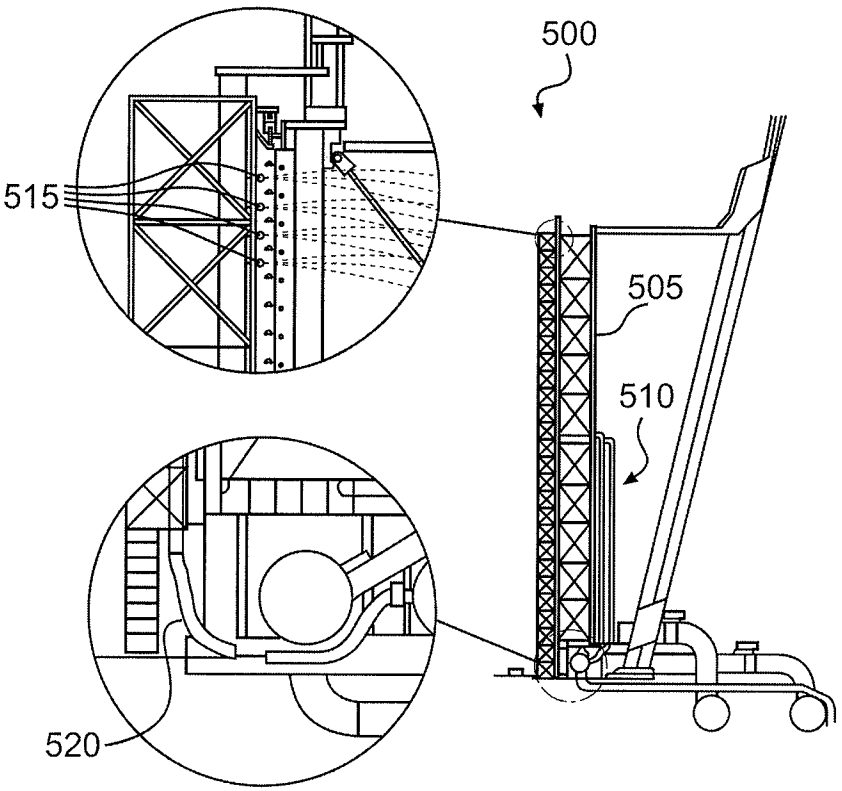
FIG. 5B is a side view of the cleaning system depicted in FIG. 5A.
Figure 5A:
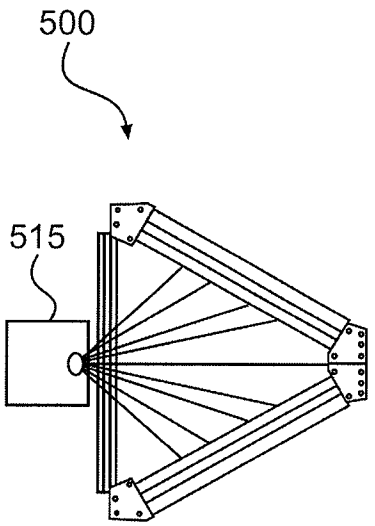
FIG. 5A is a top view of a cleaning system for a cooling tower in accordance with an embodiment of the invention.

FIGS. 5A-5B illustrate a cleaning system 500 for a pair of deltas 505, 510, in which a spray device 515 sprays water or another cleaning material into the deltas 505, 510. The spray device 515 may be supplied with cleaning material via pump system 520. Multiple spray devices 515 may be used along the length of the deltas 505, 510. The cleaning system 500 may remove debris from the tower, e.g., towers 100, 200, 300, 400, to ensure better air flow into the deltas.

Figure 6:
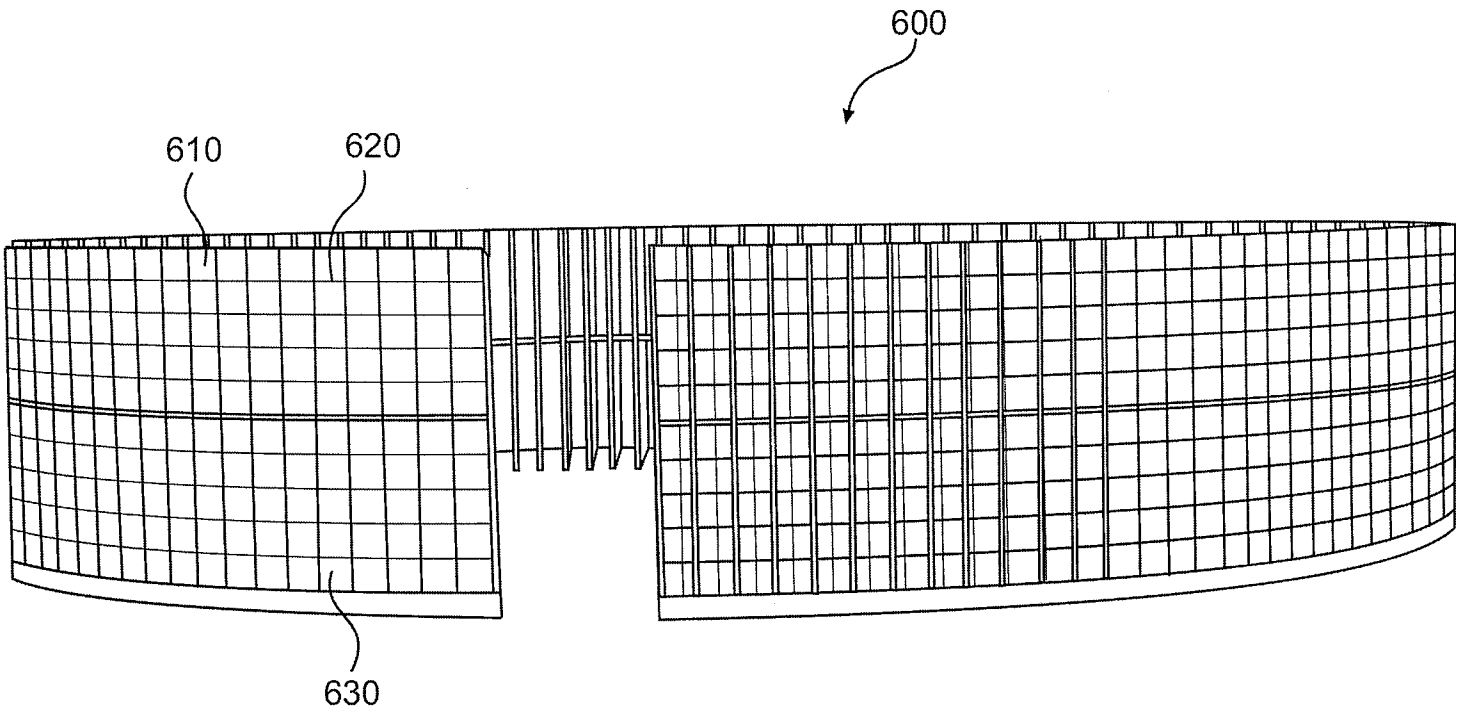
FIG. 6 is a perspective view of an array of deltas in accordance with an embodiment of the invention.
Figure 7:
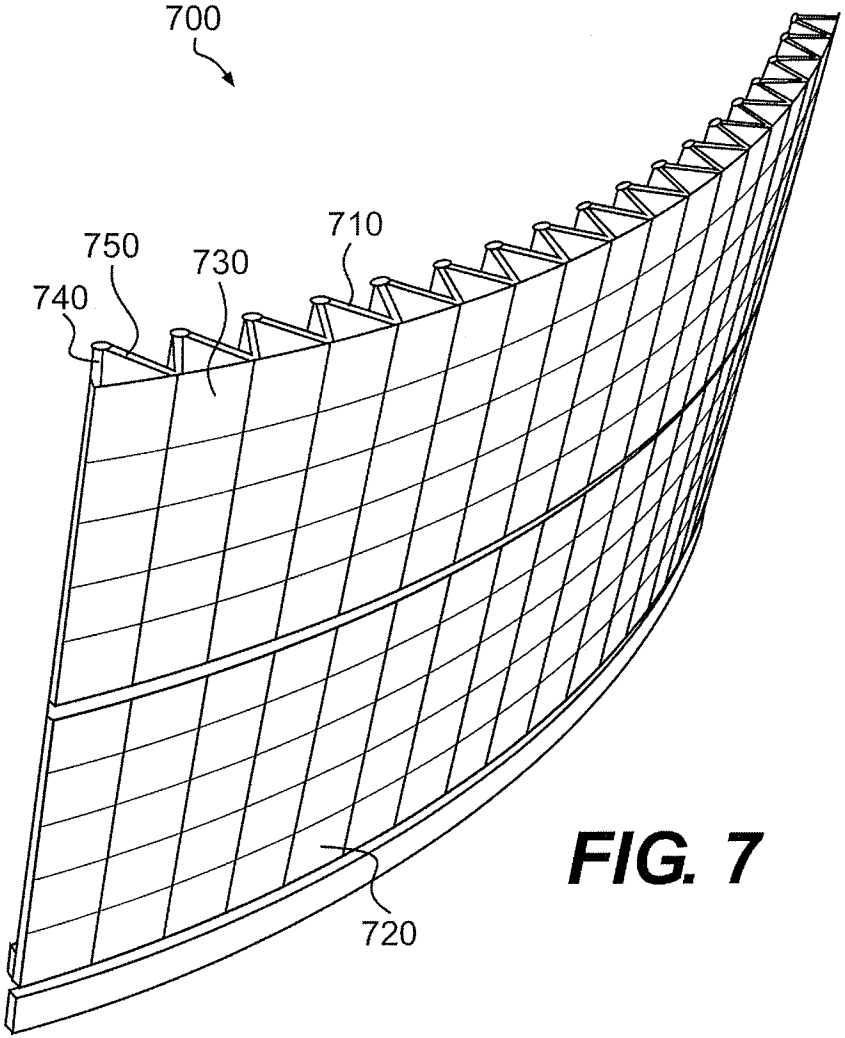
FIG. 7 is a perspective view of a section if the FIG. 6 array of deltas.

Turning now to FIG. 6, an array 600 of deltas 610 in a ring foundation is depicted. Each delta 610 includes a top delta 620 and a bottom delta 630. Each delta may reside in a sector, such as the sectors 420-427 of tower 400. FIG. 7 illustrates a portion 700 of the array 600. As can be seen, each top and bottom delta 710, 720 includes a respective louver assembly 730 and pair of heat exchanger bundles 740, 750 arranged in a triangular form, with an apex angle of 60 degrees (thus the teen, "delta"). FIG. 8 shows a detailed view of a delta 800, which may be either a top or bottom delta, e.g., top and bottom deltas 710, 720. The delta 800 includes a louver assembly 810 and pair of heat exchanger bundles 820, 830 arranged in a triangular form. A frame 840, which may be a self supporting prismatic frame, and which can be constructed from, e.g., steel, supports the heat exchanger bundle structures 820, 830.

Figure 9A:
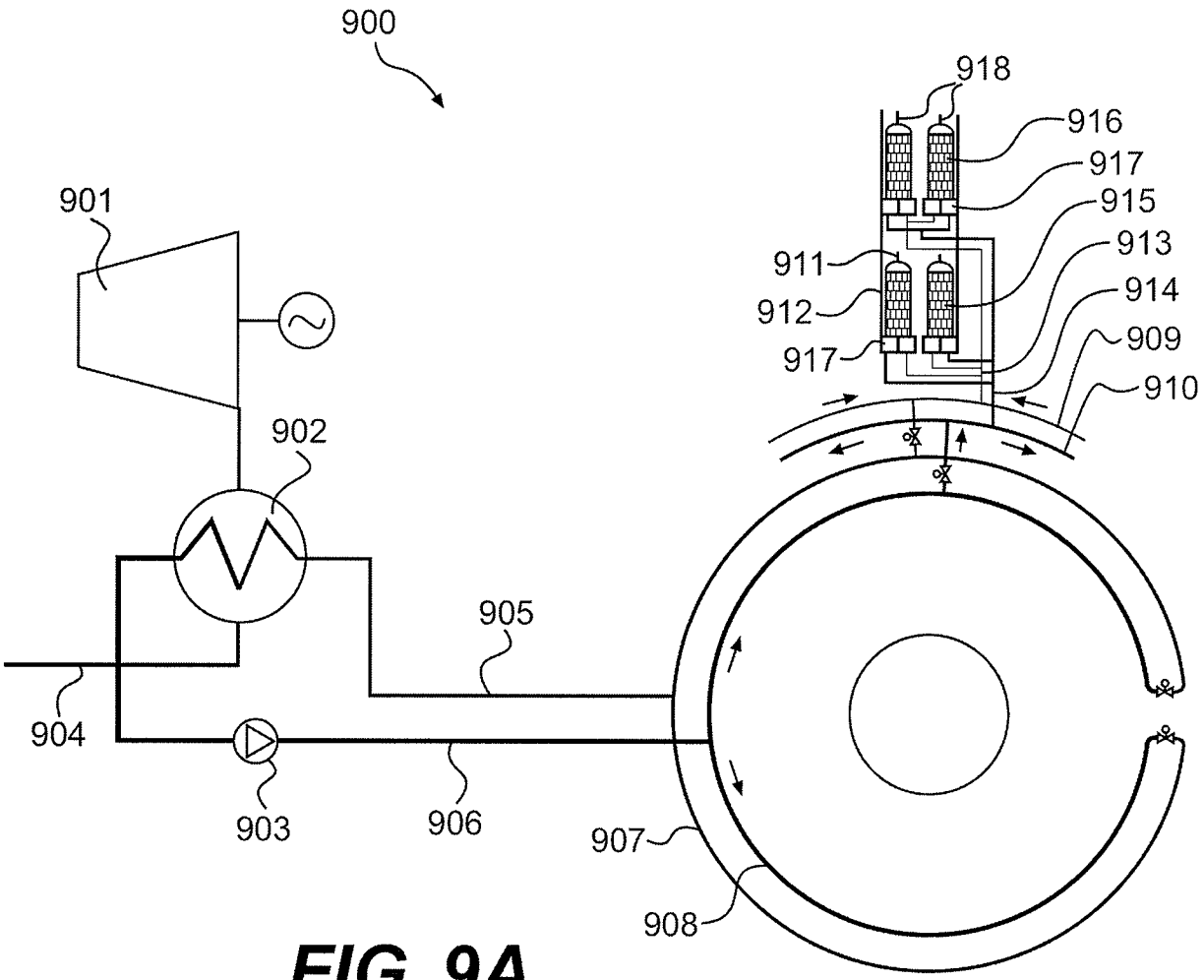
FIG. 9*a* is a schematic view of a cooling system in accordance with the present invention.

Turning now to FIG. 9*a*, a cooling system 900 may include a steam turbine 901, a surface condenser 902, a cooling water (CW) pump 903, feed water 904, a CW return main 905, a CW forward main 906, a tower return ring main 907, a tower forward ring main 908, a sector return pipe 909, a sector forward pipe 910, and a delta tower 911. The delta tower 911 may include a common steelwork 912, a delta CW return pipe, 913, a delta CW forward pipe 914, a lower delta 915, an upper delta 916, a lower split header 917, and an air vent 918.

Figure 9B:
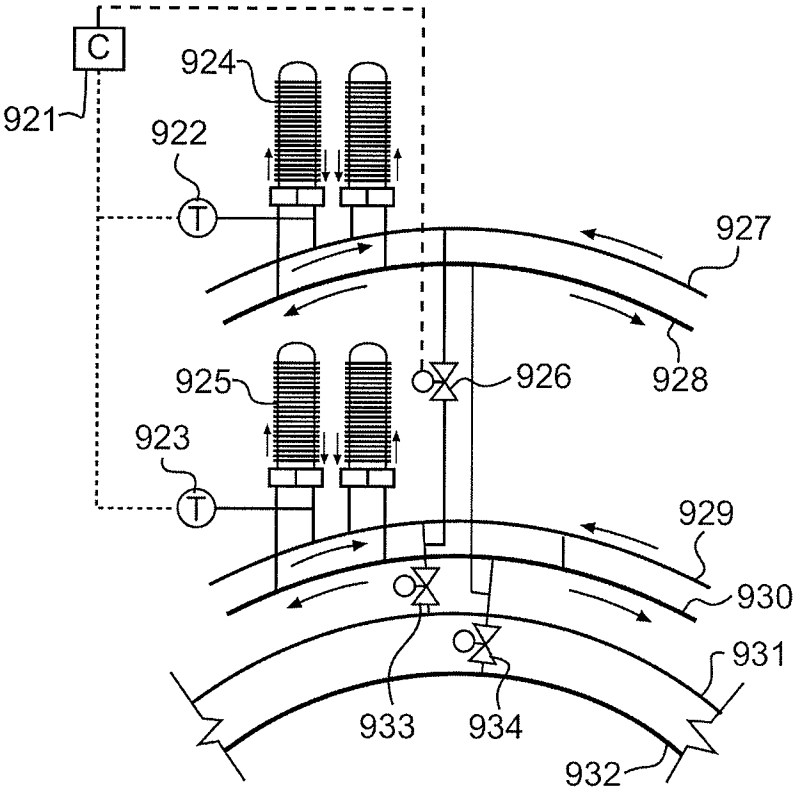
FIG. 9*b* illustrates the is a schematic view illustrating automatic control of the cooling water distribution between the bottom end top level

FIG. 9*b*, illustrates the automatic control of the cooling water distribution between the bottom end top level a cooling system, it may include a controller 921, a temperature measuring device 922 on the top level delta 924, a temperature measuring device 923 on the bottom level delta 925, the top level delta 924, the bottom level delta 925, a throttle valve 926, a sector return pipe on the top level 927, a sector forward pipe on the top level 928, a sector return pipe on the bottom level 929, a sector forward pipe on the bottom level 930, the tower return ring main 931, a tower forward ring main 932, a sector isolating valve in the return pipe 933 and a sector isolating valve 934 in the forward pipe.

Figure 10:
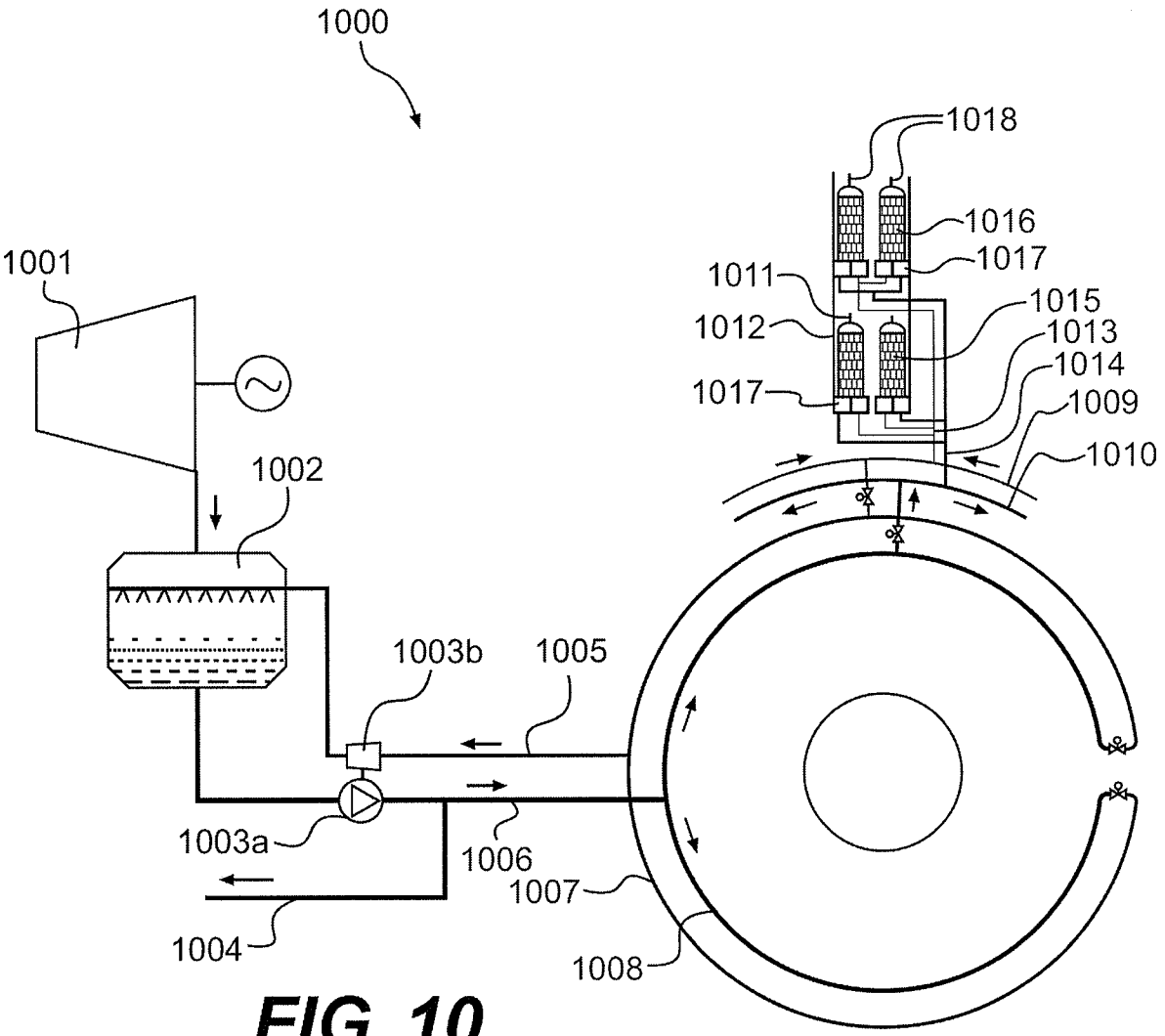
FIG. 10 is a schematic view of a cooling system in accordance with the present invention.

FIG. 10 shows a cooling system 1000 that may include a steam turbine 1001, a jet condenser 1002, a cooling water (CW) pump 1003*a*, a recovery hydroturbine 1003*b*, feed water 1004, a CW return main 1005, a CW forward main 1006, a tower return ring main 1007, a tower forward ring main 1008, a sector return pipe 1009, a sector forward pipe 1010, and a delta tower 1011. The delta tower 1011 may include a common steelwork 1012, a delta CW return pipe, 1013, a delta CW forward pipe 1014, a lower delta 1015, an upper delta 1016, a lower split header 1017, and an air vent 1018.

Figure 11A:
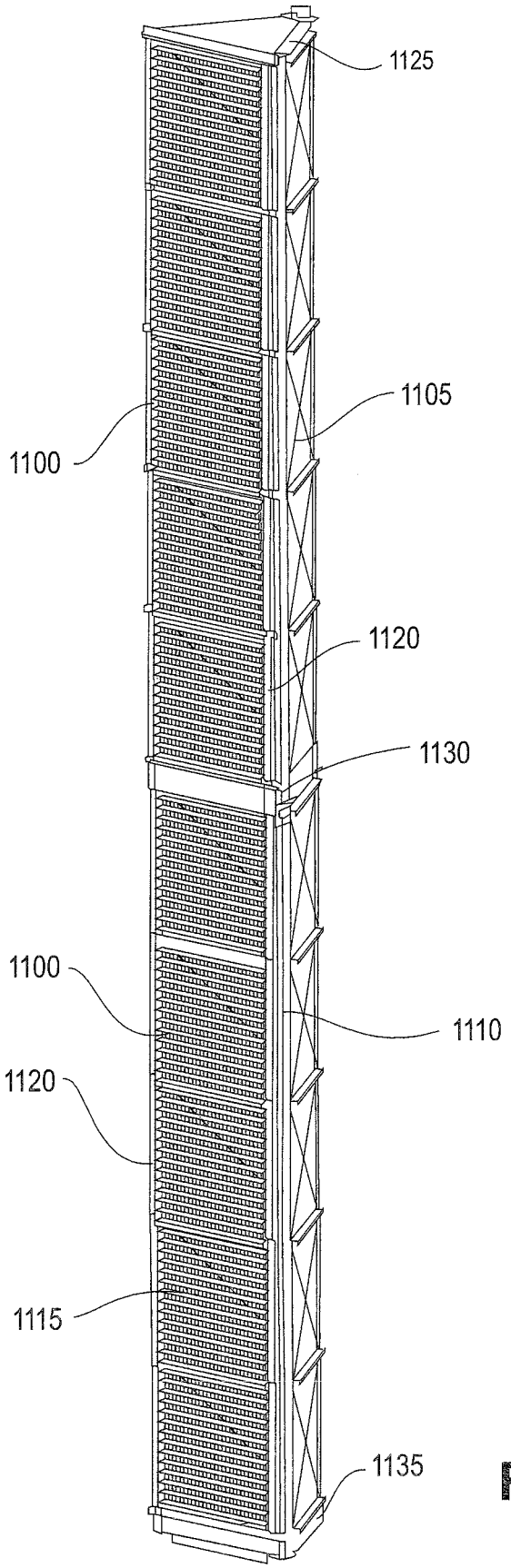
FIGS. 11A-11C are perspective views of a delta tower in in accordance with the present invention.
Figure 11B:
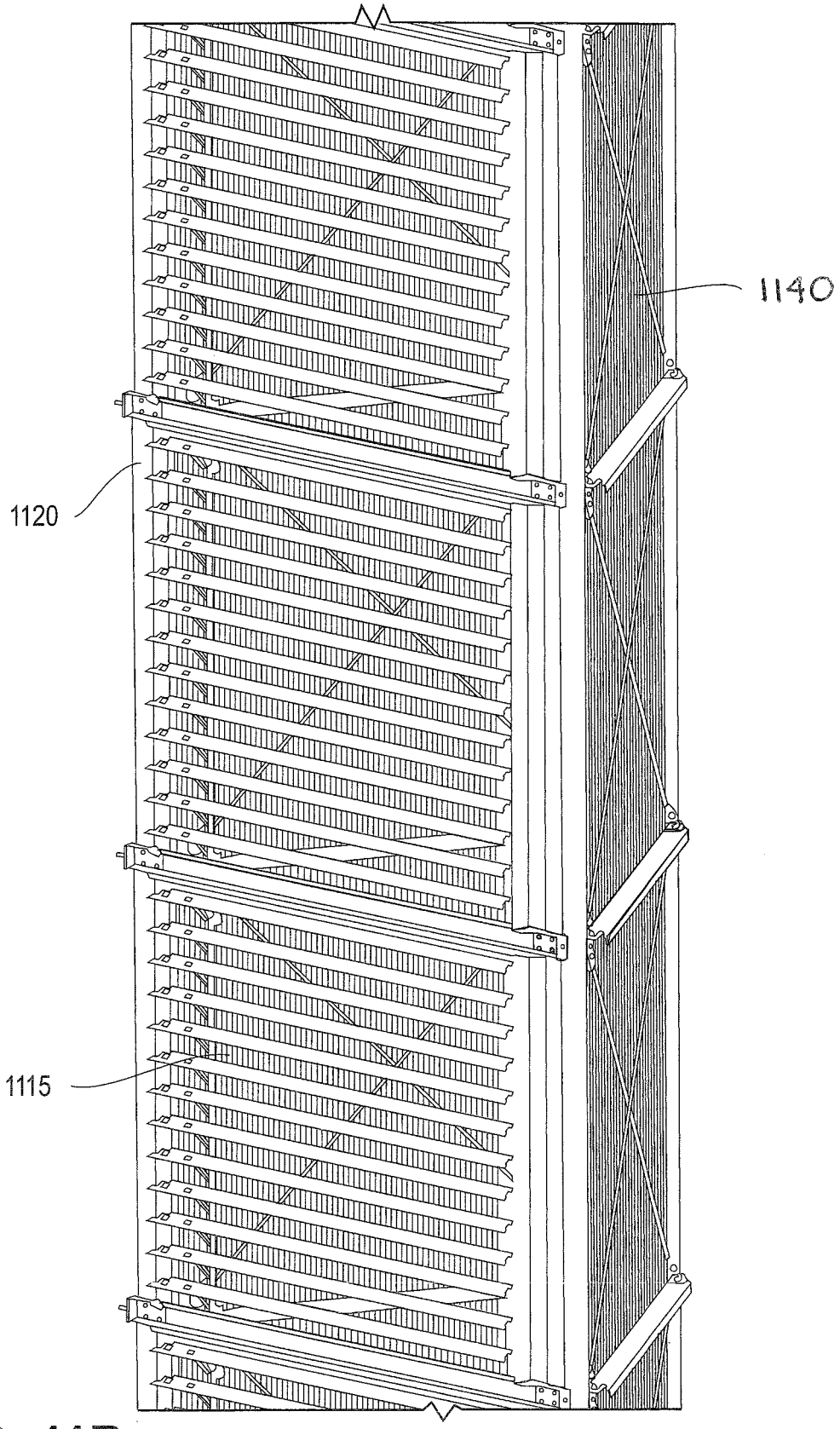
Figure 11C:
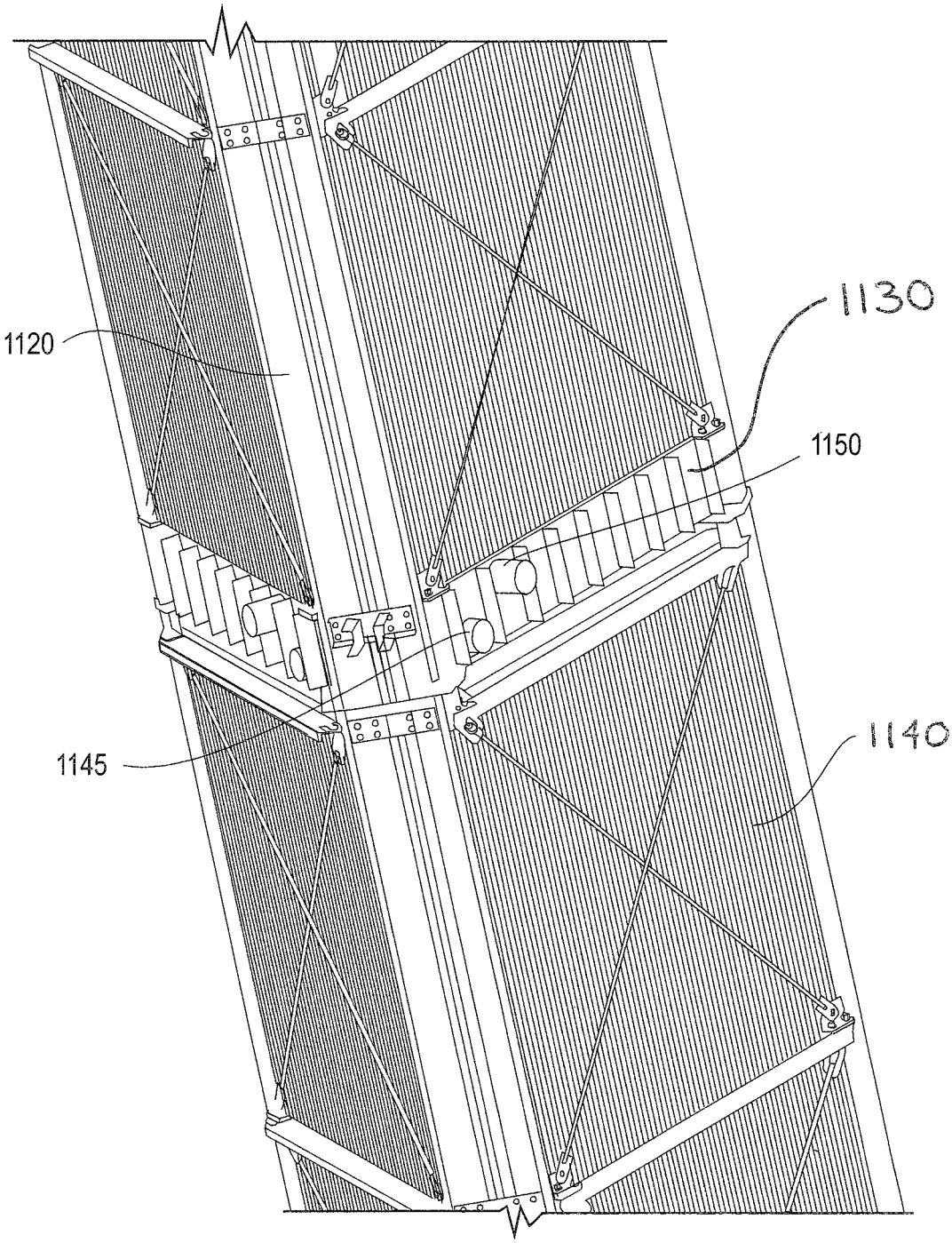

Depicted in FIGS. 11A-11C are various views of a delta tower 1100. FIG. 11A illustrates the delta tower 1100, which may include an upper delta 1105, lower delta 1110, louvers 1115, and steelwork 1120. The upper delta 1105 may include an upper header 1125 and lower header 1130. The lower delta 1110 may include a lower header 1135 and an upper header (see FIGS. 2 and 3, elements 207 and 306, for example). FIG.

11B further shows a bundle 1140 on one side of the delta tower 1100. FIG. 11C additionally depicts an inlet nozzle 1145 for receiving water to be cooled and an outlet nozzle 1150 for providing cooled water. Both nozzles 1145, 1150 may be located between the upper delta 1105 and lower delta 1110.

The processes and devices in the above description and drawings illustrate examples of only some of the methods and devices that could be used and produced to achieve the objects, features, and advantages of embodiments described herein. Thus, they are not to be seen as limited by the foregoing description of the embodiments, but only limited by the appended claims. Any claim or feature may be combined with any other claim or feature within the scope of the invention.

The many features and advantages of the invention are apparent from the detailed specification, and, thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and, accordingly, all suitable modifications and equivalents may be resorted to that fall within the scope of the invention.

What is claimed is:

1. A heat exchange apparatus for cooling a fluid, the apparatus comprising:

a first delta having an overall elongated shape that is arranged vertically at a first position along a vertical axis, the first delta including:

a first inlet conduit for receiving a first inlet fluid flow, the first inlet conduit being in fluid communication with a first inlet main, a first outlet conduit for discharging a first outlet fluid flow, the first outlet conduit being in fluid communication with the first inlet conduit through the first delta, and a first outlet main, a first header positioned above the first inlet conduit and the first outlet conduit along the vertical axis and in fluid communication with the first inlet conduit and the first outlet conduit;

a second delta having an overall elongated shape that is arranged vertically at a second position along the vertical axis, wherein said second position is above said first position, the second delta is mounted on the first delta above the first delta in a vertical direction along the vertical axis, the second delta including:

a second inlet conduit for receiving a second inlet fluid flow, the second inlet conduit being in fluid communication with a second inlet main, and a second outlet conduit for discharging a second outlet fluid flow, the second outlet conduit being in fluid communication with the second inlet conduit through the second delta, and a second outlet main;

a first connecting conduit fluidly coupled to the first inlet main and the second inlet main;

a second connecting conduit fluidly coupled to the first outlet main and the second outlet main; and a throttling device including a throttle valve disposed in at least one of the first connecting conduit and the second connecting conduit, the throttling device being configured to control the second outlet fluid flow from the second delta to the second outlet main, the first outlet fluid flow being greater than the second outlet fluid flow, wherein the first header is positioned along the vertical axis between the second delta and the first inlet conduit and the first outlet conduit of the first delta.

2. The heat exchange apparatus of claim 1, wherein each of the first and second connecting conduits includes a plurality of piping channels arranged in parallel.

3. A method for cooling a fluid, the method comprising:

providing a heat exchange apparatus including:

a first delta having an overall elongated shape that is arranged vertically at a first position along a vertical axis and including:

a first inlet conduit in fluid communication with a first inlet main, a first outlet conduit in fluid communication with a first outlet main, and a header positioned above the first inlet conduit and the first outlet conduit along the vertical axis, a second delta mounted on the first delta at a second position along the vertical axis above the first position and the header, the second delta having an overall elongated shape and including:

a second inlet conduit in fluid communication with a second inlet main, and a second outlet conduit in fluid communication a the second outlet main, a first connecting conduit that provides fluid communication between the first inlet main and the second inlet main, a second connecting conduit that provides fluid communication between the first outlet main and the second outlet main, and a throttling device including a throttle valve located in at least one of the first connecting conduit and the second connecting conduit;

flowing a first portion of the fluid through the first delta via the first inlet conduit and the header;

transferring heat from the first portion of the fluid to a first airflow through a surface of the first delta;

flowing a second portion of the fluid through the second delta;

transferring heat from the second portion of the fluid to a second airflow through a surface of the second delta;

controlling a flow rate of the second portion of the fluid with the throttling device such that a first outlet fluid flow of the first portion of the fluid from the first delta is greater than a second outlet fluid flow of the second portion of the fluid from the second delta; and controlling the second outlet fluid flow from the second delta with the throttling device.

4. A heat exchange apparatus for cooling a fluid, the apparatus comprising:

a first delta having an overall elongated shape that is arranged vertically at a first position along a vertical axis, the first delta including:

a first inlet conduit for receiving a first inlet flow, the first inlet conduit being in fluid communication with an inlet main, a first outlet conduit for discharging a first outlet fluid flow, the first outlet conduit being in fluid communication with the first inlet conduit through the first delta, and an outlet main, and a bottom level upper header positioned above the first inlet conduit and the first outlet conduit along the vertical axis and in fluid communication with the first inlet conduit and the first outlet conduit;

a second delta having an overall elongated shape that is arranged vertically at a second position along the vertical axis, wherein said second position is above said first position, the second delta is mounted on the first delta above the first delta in a vertical direction along the vertical axis, the second delta including:

a first top level lower header, a second top level lower header, a second inlet conduit for receiving a second inlet fluid flow, the second inlet conduit being in fluid communication with the inlet main through the first top level lower header, and a second outlet conduit for discharging a second outlet fluid flow, the second outlet conduit being in fluid communication with the second inlet conduit through the second delta, and the outlet main through the second top level lower header;

a first connecting conduit fluidly coupled to the inlet main and the first top level lower header; and a second connecting conduit fluidly coupled to the outlet main and the second top level lower header;

a throttling device including a throttle valve disposed in at least one of the first connecting conduit and the second connecting conduit, the throttling device being configured to control the second outlet fluid flow from the second delta to the outlet main, the first outlet fluid flow being greater than the second outlet fluid flow, wherein the bottom level upper header is positioned along the vertical axis between the second delta and the first inlet conduit and the first outlet conduit of the first delta.

5. A cooling tower for transferring heat from a fluid to an airflow, the cooling tower comprising:

at least one delta tower, including:

a first delta having an overall elongated shape that is arranged vertically at a first position along a vertical axis, the first delta including:

a first inlet conduit for receiving a first inlet fluid flow, the first inlet conduit being in fluid communication with a first inlet main, a first outlet conduit for discharging a first outlet fluid flow, the first outlet conduit being in fluid communication with the first inlet conduit through the first delta, and a first outlet main, and a first header positioned above the first inlet conduit and the first outlet conduit along the vertical axis and in fluid communication with the first inlet conduit and the first outlet conduit, a second delta having an overall elongated shape that is arranged vertically at a second position along the vertical axis, wherein said second position is above said first position, the second delta disposed above the first delta in a vertical direction along the vertical axis, the second delta including:

a second inlet conduit for receiving a second inlet fluid flow, the second inlet conduit being in fluid communication with a second inlet main, and a second outlet conduit for discharging a second outlet fluid flow, the second outlet conduit being in fluid communication with the second inlet conduit through the second delta, and a second outlet main, a first connecting conduit fluidly coupled to the first inlet main and the second inlet main;

a second connecting conduit fluidly coupled to the first outlet main and the second outlet main; and a throttling device including a throttle valve disposed in at least one of the first connecting conduit and the second connecting conduit, the throttling device being configured to control the second outlet fluid flow from the second delta to the second outlet main, the first outlet fluid flow being greater than the second outlet fluid flow, wherein the first header is positioned along the vertical axis between the second delta and the first inlet conduit and the first outlet conduit of the first delta.

6. The cooling tower of claim 5, wherein the at least one delta tower consists of a plurality of delta towers.

* * * * *